United States Patent [19]

Fisher

[11] 4,270,321

[45] Jun. 2, 1981

[54] METHOD AND MEANS OF INSULATING A BUILDING FOUNDATION WALL

[76] Inventor: Thomas E. Fisher, 21 Crestwood Dr., Council Bluffs, Iowa 51501

[21] Appl. No.: 122,572

[22] Filed: Feb. 19, 1980

[51] Int. Cl.[3] ..... E04B 1/80; E02D 19/18

[52] U.S. Cl. ..... 52/97; 52/169.11; 52/275; 52/467; 52/742

[58] Field of Search ..... 52/169.11, 169.5, 97, 52/467, 275, 278, 742

[56] References Cited

U.S. PATENT DOCUMENTS

| | | | |
|---|---|---|---|
| 800,609 | 4/1931 | Drake | 52/278 |
| 1,625,637 | 4/1927 | Abel | 52/467 |
| 2,115,270 | 4/1938 | Leash | 52/467 |
| 2,743,602 | 5/1956 | Dunn | 52/169.11 X |
| 3,162,906 | 12/1964 | Dudley | 52/97 |
| 3,445,972 | 5/1969 | Carr | 52/98 |
| 3,458,963 | 8/1969 | Klein | 52/288 |

FOREIGN PATENT DOCUMENTS

| | | | |
|---|---|---|---|
| 191589 | 9/1957 | Australia | 52/169.9 |
| 242908 | 10/1965 | Australia | 52/97 |
| 970582 | 7/1975 | Canada | 52/169.11 |
| 1964769 | 9/1970 | Fed. Rep. of Germany | 52/169.14 |
| 2043030 | 4/1971 | Fed. Rep. of Germany | 52/169.11 |

*Primary Examiner*—Alfred C. Perham

*Attorney, Agent, or Firm*—Zarley, McKee, Thomte, Voorhees & Sease

[57] ABSTRACT

A method of insulating a building having a foundation wall disposed at least partially below grade includes substantially covering the exterior surface of the foundation wall with panels of insulation material, securing the panels thereto with flanged retaining members interposed between adjacent edges of adjacent panels. The retaining members are secured to the foundation wall with the flanges thereof partially overlying the adjacent panels. The top edge of the insulation material is then covered to prevent the impingement of water and foreign matter onto the top edge and between the panels and foundation wall.

A system for securing panels of insulation material to the exterior surface of a building foundation wall includes a plurality of flanged retaining members, each including a base portion and at least one flange laterally extended from the base portion to overly a panel in abutment with the base portion. The system contemplates securing the base portions to the exterior foundation wall surface and protecting the top edge of the panels with an elongated rain shield adapted for securement to the exterior wall surface and including a downwardly and outwardly inclined top surface for directing water, foreign matter and the like exteriorly of the panels and retaining members. Those portions of the panels and retaining members which are exposed above grade may be covered with siding or the like.

13 Claims, 11 Drawing Figures

METHOD AND MEANS OF INSULATING A BUILDING FOUNDATION WALL

BACKGROUND OF THE INVENTION

The present invention relates generally to thermal insulation and more particularly to a method and means for applying insulation to the exterior surface of a building foundation wall to prevent the heating and cooling effect of the basement floor from being dissipated.

Prior attempts to insulate building basements and rooms which are situated partially below grade have been directed to the application of insulation to the interior surface of the foundation wall. Such systems can substantially reduce heat transfer between the building wall and foundation wall but do nothing to prevent heat transfer between the foundation wall and the outside ground or atmosphere. Thus the heating and cooling effect of the basement floor, which is in direct thermal communication with the foundation walls, is largely dissipated to the surrounding ground and atmosphere and therefore unavailable for reducing the heating and air conditioning load for the building.

Accordingly, a primary object of the invention is to provide an improved method and system for insulating a building foundation wall.

A further object is to provide an improved method and system of insulating a building foundation wall which minimizes heat transfer between the foundation wall and surrounding ground and atmosphere.

A related object is to provide an improved method and system of insulating a building foundation wall which enables the generally constant temperature basement floor to modulate the temperature within the building.

A further related object is to provide an improved method and system of insulating a building foundation wall which minimizes the heating and air conditioning load for the building.

A further object is to provide an improved method and system for insulating the exterior surface of a building foundation wall wherein the top edge of the insulation material and seam between the insulation and foundation wall are protected from the impingement of rain, dirt and the like.

A further object is to provide an improved method and system of insulating the exterior surface of a building foundation wall whereby those portions of the foundation wall disposed above grade are made aesthetically attractive.

Finally, an object is to provide an improved method and system of insulating a building foundation wall which includes a minimum number of different parts which may be quickly and easily installed to provide efficient insulation.

SUMMARY OF THE INVENTION

The method of the present invention for insulating a building having a foundation wall disposed at least partially below grade includes substantially covering the exterior surface of the foundation wall with panels of insulation material and securing the panels against the exterior surface by interposing flanged retaining members between the adjacent edges of adjacent panels and securing the retaining members to the foundation wall. The retaining members have flanges which at least partially overly the adjacent panels for retaining them in position against the foundation wall. Finally, the top edge of the insulation material is covered to prevent the impingement of rain, dirt and the like onto the top edge and between the panels and foundation wall.

The foundation wall insulating system of the invention includes a plurality of flanged retaining members, each having a base portion adapted for abutment against an edge of at least panel and at least one flange laterally extended from the base portion so as to partially overly the panel. Means are provided for securing the base portion to the exterior wall surface so that the flanges therefor are operative to retain the insulation panel against the exterior wall surface. An elongated rain shield is secured to the exterior wall surface at a position in engagement with the top edge of the insulation panels and includes a downwardly and outwardly inclined top surface for directing water, foreign matter and the like exteriorly of the panels and retaining members.

The retaining members may include specially designed retaining members for use on flat surface, as well as interior and exterior corners of the foundation wall. Those portions of the retaining members and panels which are disposed above grade may be covered with siding or the like to protect the insulation and present an attractive aesthetic appearance.

DESCRIPTION OF THE PREFERRED EMBODIMENTS

Figure 1:
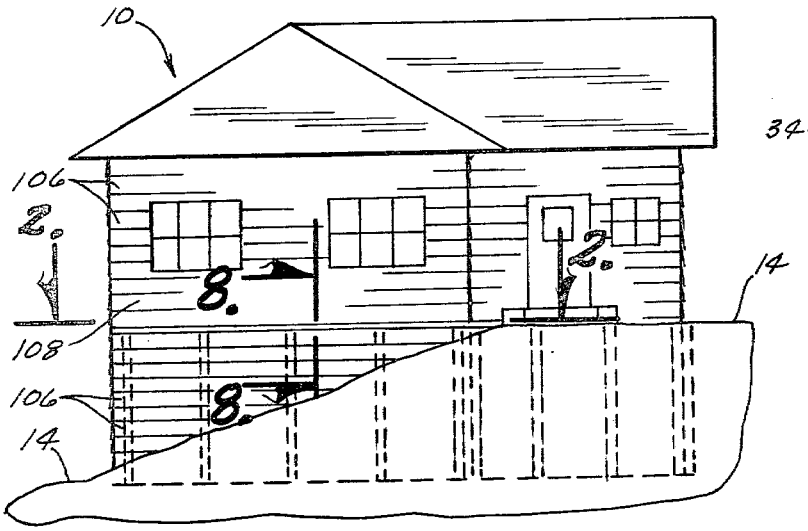
FIG. 1 is an elevational view of a building having a foundation wall disposed partially above and below grade.
Figure 2:
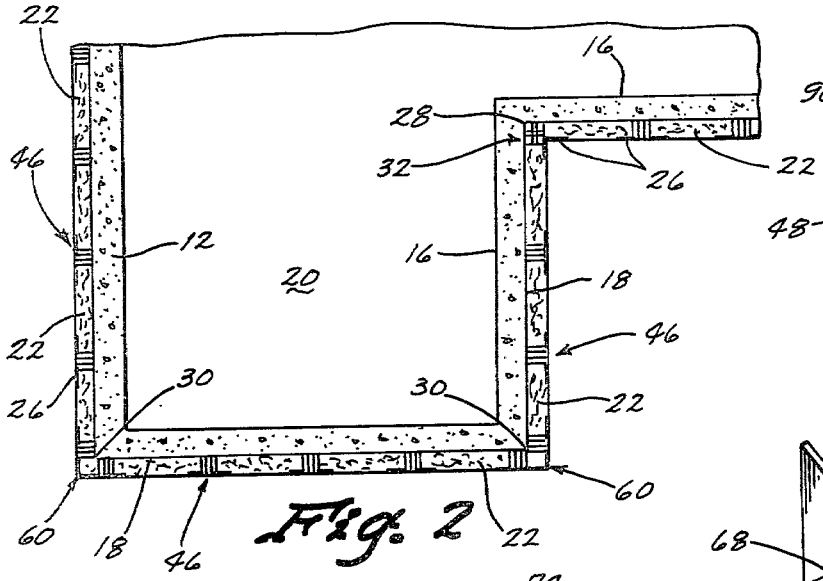
FIG. 2 is a top sectional view of the foundation wall taken along line 2—2 in FIG. 1.

FIGS. 1 and 2 disclose a building 10 having a foundation wall 12 which is disposed partially below grade and partially above grade as seen in FIG. 1 relative to the ground surface 14. The foundation wall 12, which has an interior surface 16 and an exterior surface 18, is in intimate contact with the basement floor 20 of the building 10. Whereas building 10 most closely resembles a residential building, it will be apparent that the present invention is adapted for commercial, industrial and farm buildings as well.

The insulating system of the present invention contemplates substantially covering the exterior surface 18 of the foundation wall 12 with a plurality of panels 22 of insulation material. The panels are preferably rectangular sheets of solid insulation such as styrofoam or polyurethane, often referred to as bead board. The panels are arranged in upright spaced apart relation with each panel including a top edge 23 and opposite side edges 24.

To secure the insulation panels 22 against the exterior surface 18 of the foundation wall 12, there is provided a plurality of flanged retaining members 26, each including an elongated base portion adapted for abutment against a side edge 24 of at least one panel 22, and at least one flange laterally extended from the base portion so as to partially overly a panel in abutment with the base portion. It can be seen in FIG. 2 that several different types of retaining members 26 are required to accommodate the flat surfaces of the foundation wall 12 as well as the interior and exterior corners 28 and 30 respectively.

Figure 4:
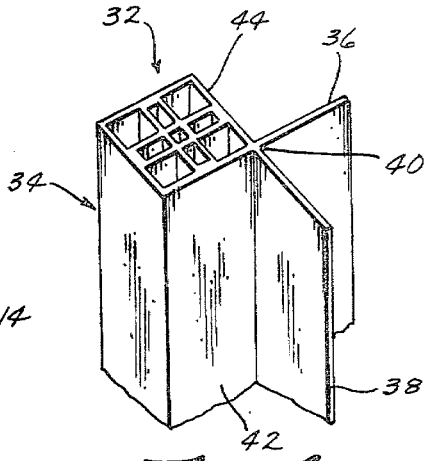
FIG. 4 is a detail foreshortened perspective view of an interior corner retaining member.
Figure 9:
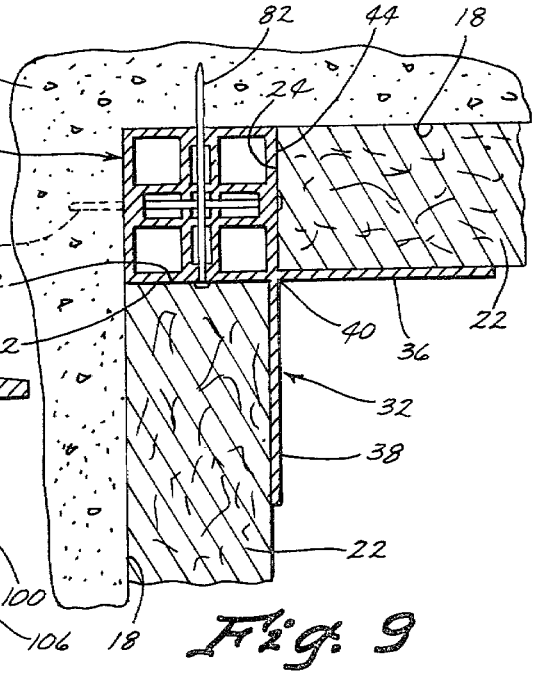
FIG. 9 is a top sectional view showing the interior corner retaining member of FIG. 4 installed on a foundation wall.

An interior corner retaining member 32 is shown in FIGS. 2, 4 and 9 as including a square section base member 34 and a pair of flanges 36 and 38 extended laterally from one corner 40 of the base member 34. The flanges 36 and 38 are arranged perpendicular to one another and parallel to respective sides 42 and 44 of base member 34. It can be seen in FIG. 9 that the base member 34 is fitted into the corner with the flanges 36 and 38 disposed in parallel spaced apart relation from the perpendicularly related foundation wall surfaces.

Figure 5:
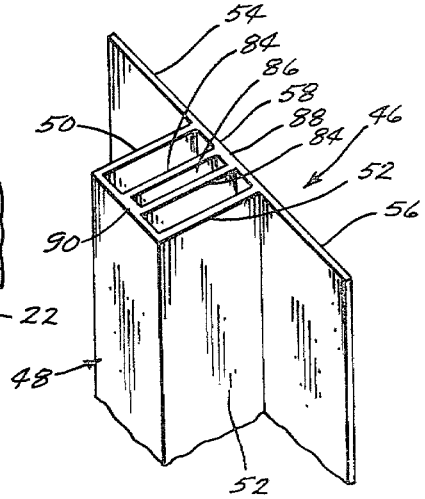
FIG. 5 is a detail foreshortened perspective view of a flat surface retaining member.
Figure 10:
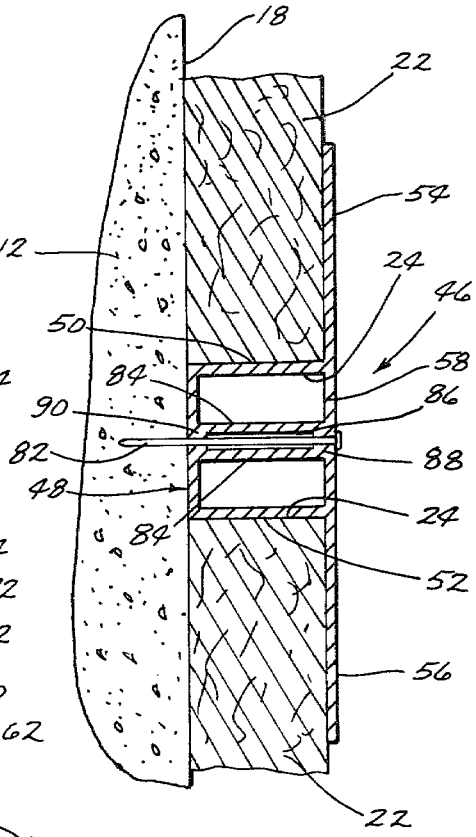
FIG. 10 is a top sectional view showing the flat surface retaining member installed on a foundation wall.

A flat surface retaining member 46 is shown in FIGS. 2, 5 and 10 as including an elongated base member 48 having parallel spaced apart sidewalls 50 and 52 adapted for abutment against the adjacent side edges 24 of adjacent panels 22. A pair of flanges 54 and 56 extend laterally from the opposite sidewalls 50 and 52 of base member 48 at right angles to the respective sidewalls and in a common plane with the exterior sidewall 58.

Figure 6:
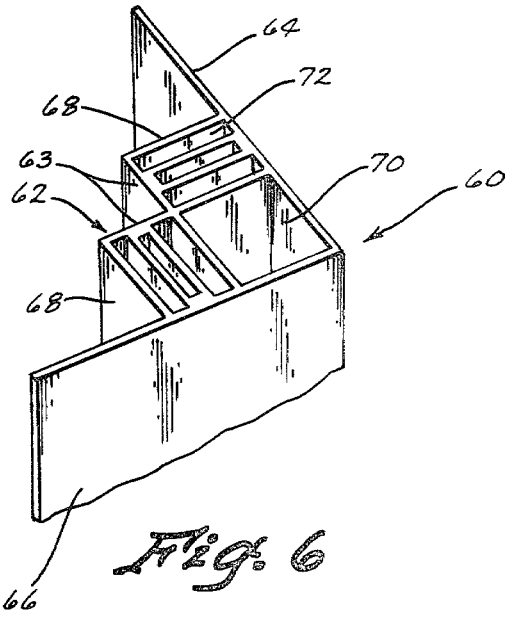
FIG. 6 is a detail foreshortened perspective view of an exterior corner retaining member.
Figure 11:
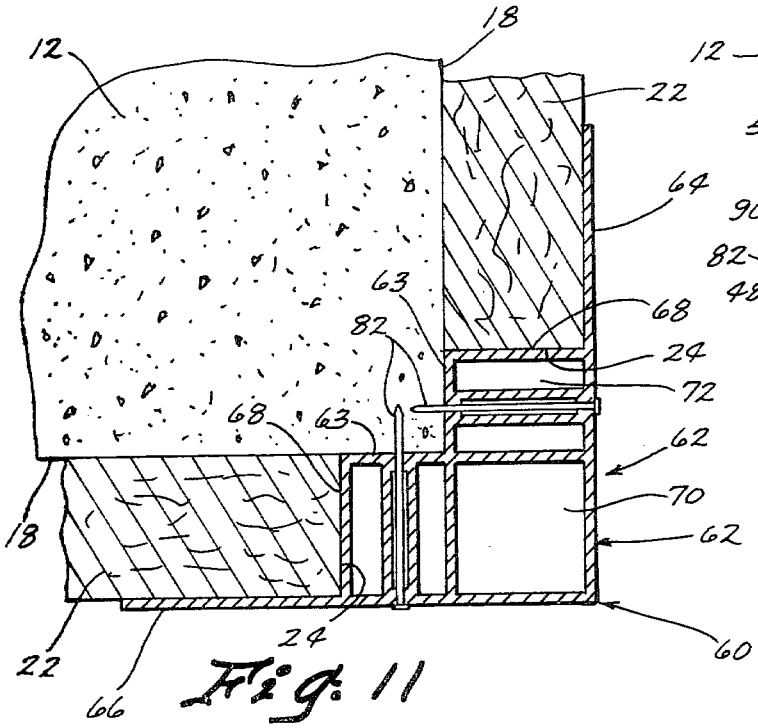
FIG. 11 is a top sectional view showing the exterior corner retaining member installed on a foundation wall.

An exterior corner retaining member 60 is shown in FIGS. 2, 6 and 11 as including an elongated generally L-section base member 62 which defines an interior generally right angle section channel 64 adapted for receiving an exterior corner 30 of the foundation wall 12. A pair of flanges 64 and 66 are oriented at right angles to one another and spaced exteriorly of the channel 64 for retaining insulation panels 22 against the foundation walls forming the exterior corner 30. In the embodiment shown, base member 62 comprises three integrally formed square tubing sections 68, 70 and 72 having exterior surfaces which form a corner and which are disposed in common planes with the flanges 64 and 66.

Figure 7:
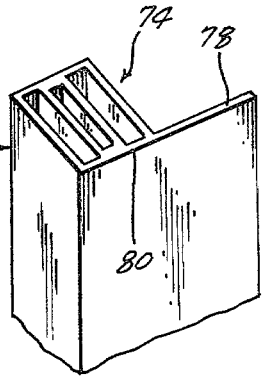
FIG. 7 is a detail foreshortened perspective view of a wall end retaining member.

FIG. 7 illustrates an optional wall end retaining member 74 including an elongated square section base member 76 having a flange 78 extended laterally therefrom and in a common plane with one side 80 thereof. Retaining members 74 may be used at the end of a single wall surface or a pair of retaining members 74 may be used in combination as a substitute for the interior corner retaining member 32.

The various retaining members 26 may be secured to the foundation wall 12 by any various conventional fastening means including adhesives. A preferred securement means however is illustrated in FIGS. 8–11 wherein it is seen that a plurality of nails or elongated fasteners 82 are inserted through the retaining members 26 and into the foundation wall 12. For this purpose, it can be seen with reference to FIGS. 5 and 10 that each base member includes a pair of closely spaced apart webs 84 which define a slot 86 therebetween for receiving the nail 82. In addition, the wall portions through which the nail is inserted are of increased thickness as at 88 and 90 for greater strength. It is seen that the webs 84 reinforce the base member portion of the retaining members in a direction to resist the forces of installing the fasteners 82. In FIGS. 4 and 9, it is seen that the base member 34 of the interior corner retaining member 32 includes perpendicular pairs of webs for insertion of fasteners through both pair of opposite sidewalls. Whereas the nails 82 may be inserted with the use of a conventional hammer, they are most quickly and easily installed with the use of a powder actuated gun.

Figure 3:
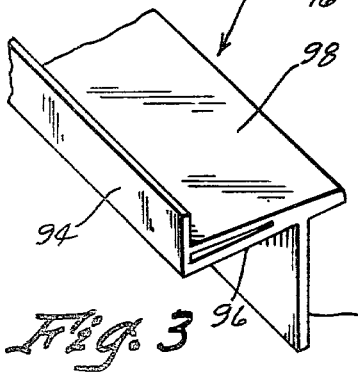
FIG. 3 is an enlarged detail perspective view of the rain shield of the invention.
Figure 8:
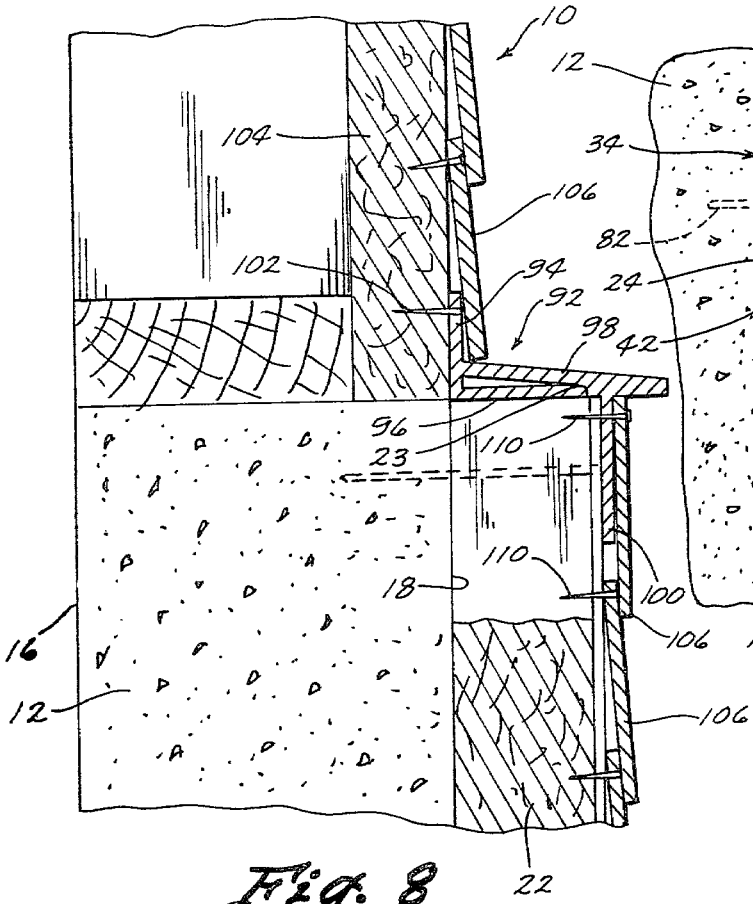
FIG. 8 is an enlarged side sectional view taken along line 8—8 in FIG. 1.

Referring to FIGS. 3 and 8, the insulating system of the invention further provides an elongated rain strip or shield 92 which includes a short upright top flange 94 connected to a top plate 96 having a downwardly and outwardly inclined top surface 98. A depending flange 100 may be provided for engaging the exterior surface of an insulation panel 22 which is covered by the rain shield 92. As seen in FIG. 8 the rain shield 92 is adapted for securement relative to said exterior wall surface 18 at a position in engagement with the top edge 23 of panel 22. The rain shield 92 is secured in position by a plurality of nails 102 driven through top flange 94 into the building wall board 104 which rests on the foundation wall 12. The rain shield 92 thus both covers the top edges 23 of the panels 22 and substantially seals the seam between the panels and foundation wall 12.

To further protect that portion of the insulation panels 22 and retaining members 26 which are disposed above grade and to present a pleasing aesthetic appearance, building's siding 106 may be applied over the above grade portions of the insulation panels and retaining members to match the siding on the upper frame portion of the house as indicated at 108 in FIG. 1. The nails 110 for securing the siding in place are preferably driven through the base members of the respective retaining members 26.

Whereas the rain shield 92 and retaining members 26 may be formed of any suitable material, each is preferably and integrally formed of plastic extrusion of polyvinyl chloride or the like which is essentially a non-conductor of thermal energy. Whereas insulation panels are generally installed on interior basement walls between wood furring strips which would be subject to termites and rotting if used on the exterior surface, the plastic retaining strips of the present invention are immune to such problems and furthermore are fire resistant so as to actually protect a home from brush fires and the like.

Whereas a preferred embodiment of the various retaining strips and rain shield is shown and described herein, it is to be understood that the cross sectional shape of both the retaining strip base members and rain shield may be varied without departing from the present invention.

In cold winter weather, the insulation system of the present invention insulates the foundation wall from the cold ambient air and cold upper layers of ground above the frost line which may extend to a depth of four feet or more. The basement floor however tends to take on the relatively constant temperature of the building footings and thereby act as a heat sink for modulating the temperature within the building. By insulating the exterior surface of the building foundation walls according to the method and system of the present invention, the foundation walls provide for conduction of heat upwardly from the basement floor for radiation into the building. The insulation panels installed according to the method of the present invention insulate the thermal mass of the foundation walls from the heating and cooling effects of the surrounding ground and atmosphere. The result is a substantial reduction in the cost of heating and air conditioning by making the structure more energy efficient. The heating and cooling effect of the basement floor is thereby prevented from being dissipated.

Thus there has been shown and described a method and means of insulating a building foundation wall which accomplishes at least all of the stated objects.

I claim:

1. A method of insulating a building having a foundation wall disposed at least partially below grade, said foundation wall having interior and exterior surfaces, comprising, substantially covering the exterior surface of said foundation wall with a plurality of panels of insulation material, securing said panels against said exterior surface by interposing flanged retaining members between adjacent edges of adjacent panels with the flanges thereof at least partially overlying said adjacent panels, and securing said retaining members to said foundation wall, covering the top edge of said insulation material including sealing the seam between said top edge and exterior surface of said foundation wall, thereby preventing the impingement of water and foreign matter onto said top edge and between said panel and foundation wall, the step of sealing said seam comprising positioning an elongated rain strip on said top edge and securing said rain strip to said exterior surface of said foundation wall, providing said retaining members as elongated retaining strips including a central abutment portion and a pair of flanges directed outwardly therefrom, and abutting adjacent panels against opposite sides of the central abutment portion of the retaining strip interposed therebetween.

2. The method of claim 1 further comprising excavating a space adjacent said foundation wall to provide space for installing said panels of insulation material and retaining members, and backfilling said space subsequent to the installation of said panels and retaining members.

3. The method of claim 1 wherein the step of securing said retaining members includes inserting a fastener through said retaining member and into the foundation wall.

4. The method of claim 1 further comprising applying an exterior covering over those portions of said panels and retaining members which are disposed above grade.

5. A method of insulating a building having a foundation wall disposed at least partially below grade, said foundation wall having interior and exterior surfaces, comprising, substantially covering the exterior surface of said foundation wall with a plurality of panels of insulation material, securing said panels against said exterior surface by interposing flanged retaining members between adjacent edges of adjacent panels with the flanges thereof at least partially overlying said adjacent panels, and securing said retaining members to said foundation wall, covering the top edge of said insulation material including sealing the seam between said top edge and exterior surface of said foundation wall, thereby preventing the impingement of water and foreign matter onto said top edge and between said panel and foundation wall, the step of sealing said seam comprising positioning an elongated rain strip on said top edge and securing said rain strip to said exterior surface of said foundation wall, providing said retaining members as elongated retaining strips including a central abutment portion and a pair of flanges directed outwardly therefrom, and arranging adjacent panels sufficiently close to the opposite sides of the central abutment portion of the retaining strip interposed therebetween that said pair of flanges of the retaining strip at least partially overlie said adjacent panels.

6. In combination with a building having a foundation wall disposed at least partially below grade, said foundation wall having interior and exterior surfaces, a system for securing a plurality of panels of insulation material to the exterior surface of the building, comprising, a plurality of panels of insulation material arranged relative to said foundation wall to substantially cover the exterior surface thereof, a plurality of flanged retaining members secured to the exterior surface of said foundation wall, each retaining member including an elongated base portion interposed between adjacent edges of adjacent panels, and a pair of flanges laterally extended from said base portion so as to at least partially overlie the exterior surfaces of said adjacent panels for retaining said panels in position against the foundation wall, means for securing said base portion to said exterior wall surface whereby said pair of flanges are operative to retain said panels against said exterior wall surface, and an elongated rain shield secured to said exterior wall surface at a position in engagement with the top edge of said panels and including a downwardly and outwardly inclined top surface for directing water, foreign matter and the like exteriorly of said panels and retaining members.

7. The system of claim 6 wherein said flanged retaining members include a flat surface retaining member including an elongated base member having parallel spaced apart sidewalls adapted for abutment against the adjacent sides of adjacent panels and a pair of parallel flanges laterally extended from opposite sides of said base member at right angles thereto.

8. The system of claim 7 wherein said flanged retaining members include an exterior corner retaining member including a generally L-section base member defining an interior generally right angle section channel adapted for receiving an exterior corner of a foundation wall and a pair of flanges disposed at right angles to one another and exteriorly of said channel for retaining insulation panels against the foundation walls forming said exterior corner.

9. The system of claim 8 wherein said flanged retaining members include an interior corner retaining member including a generally rectangle section base member and a pair of flanges extended laterally from one corner of said base member, said flanges being arranged perpendicular to one another and parallel to respective sides of said base member.

10. The system of claim 8 wherein said flanged retaining members include an end retaining member including an elongated generally rectangle section base member and a flange extended laterally therefrom and parallel to one side thereof.

11. The system of claim 6 wherein said means for securing said base portion includes a fastener adapted for insertion through said base member and into said foundation wall.

12. The system of claim 11 wherein said base portion of said retaining members includes a pair of closely spaced apart webs defining a slot therebetween for receiving said fastener.

13. The system of claim 6 wherein said retaining members and rain shield are integrally formed plastic extrusions.

* * * * *